US005957192A

United States Patent [19]

Kitamura et al.

[11] Patent Number: 5,957,192

[45] Date of Patent: Sep. 28, 1999

[54] METHOD FOR CONTROLLING INJECTION IN A DIE CASTING MACHINE AND APPARATUS FOR THE SAME

[75] Inventors: Hiroshi Kitamura, Zama; Makoto Tsuji, Yamato; Noboru Fujiyoshi, Zama, all of Japan

[73] Assignee: Toshiba Kikai Kabushiki Kaisha, Tokyo, Japan

[21] Appl. No.: 09/199,422

[22] Filed: Nov. 25, 1998

[30] Foreign Application Priority Data

Nov. 27, 1997 [JP] Japan ..... 9-325949

[51] Int. Cl.[6] ..... B22D 17/32; B22D 37/00

[52] U.S. Cl. ..... 164/457; 164/154.1; 164/155.3; 164/155.4; 164/155.5; 164/113; 164/312; 164/133; 164/337

[58] Field of Search ..... 164/457, 154.1, 164/155.3, 155.4, 155.5, 113, 312, 4.1, 133, 337

[56] References Cited

U.S. PATENT DOCUMENTS 5,052,468 10/1991 Koenig ..... 164/457
5,365,999 11/1994 Stummer et al. ..... 164/457
5,662,159 9/1997 Iwamoto et al. ..... 164/457

FOREIGN PATENT DOCUMENTS 64-53754 3/1989 Japan ..... 164/457

*Primary Examiner*—Harold Pyon
*Assistant Examiner*—I.-H. Lin
*Attorney, Agent, or Firm*—Finnegan, Henderson, Farabow, Garrett & Dunner, L.L.P.

[57] ABSTRACT

A method and an apparatus for controlling an injection of a die-casting machine, the apparatus having an open-shut valve for opening and shutting a hydraulic channel through which hydraulic fluid is discharged from a boost cylinder device and a boost cylinder flow-control valve for regulating a flow of the hydraulic fluid discharged from the boost cylinder device. When a highly viscous molten material is injected toward a casting mold and the molten material reaches a gate of the casting mold, an injection resistance is increased. At this time, by regulating the hydraulic channel with the control valves to discharge the hydraulic fluid in accordance with a predetermined program, the boost cylinder device applies further pressure to the injecting piston to assist injection process, thereby preventing inappropriate change in injection speed. Consequently, the open-shut valve is opened to conduct ordinary pressure boosting pressure process.

6 Claims, 14 Drawing Sheets

METHOD FOR CONTROLLING INJECTION IN A DIE CASTING MACHINE AND APPARATUS FOR THE SAME

BACKGROUND OF THE INVENTION

1. Field of the Invention

The present invention relates to a method for controlling injection in a die casting machine and apparatus for the same. More specifically, it relates to an injection control in a die casting machine for producing a high-quality die-casting product.

2. Description of Related Art

[Die-Casting Machine and Pressurization]

Conventionally, it is known that a quality of a die-casting product is greatly influenced by an injection speed and an injection pressure in filling molten material in a casting mold. Especially, the molten material has to be sufficiently pressurized before the molten material solidifies. For that reason, a high-filling-injection-power type die-casting machine having an injection cylinder of large diameter is conventionally known.

However, though the above-described die-casting machine can generate a great filling injection power, the filling injection power is unstable and difficult to reproduce precisely since back pressure of the injection cylinder is controlled on meter-out side while the injection cylinder is in operation. Furthermore, the above-described die-casting machine is inferior in view of energy consumption.

Accordingly, another type of die-casting machine having two-stage driving cylinder (for injecting and boosting pressure of the molten material) device comes to be employed in recent years.

Generally, an injection plunger is advanced at a low speed to initiate filling the molten resin into a mold cavity, thereby preventing air from letting in the molten material. After the head of the molten material reaches a gate portion of the mold to increase a pressure of an injection cylinder device for filling the molten resin, the injection plunger is advanced at a high speed so that a temperature of the molten material is not lowered, thereby rapidly filling the molten material into the mold cavity.

After above-described injection process, a high pressure is applied to the injection cylinder device by a boost cylinder device to boost the pressurization to the molten material in the mold by the injection plunger (boosting pressure process) when the molten material is filled in the mold to further increase the pressure of the injection cylinder device or when the injection plunger is advanced to a predetermined position corresponding to completion of filling the molten material.

[Tow-Stage Cylinder Die-Casting Machine]

The conventional two-stage cylinder die-casting machine is specifically described below.

In FIG. 10, the die-casting machine has an injection sleeve 93 into which molten material 92 to be filled into a mold cavity 91, an injection cylinder device 95 for driving the injection plunger 94 to inject the molten material 92, and a boost cylinder device 96 having a large diameter for applying high pressure to hydraulic fluid at a back side of the injection cylinder device 95 after completion of filling the molten material 92. Accordingly, a pressure applied to the molten material 92 filled in the mold cavity 91 is boosted through the injection cylinder device 95.

FIG. 11 shows an injection speed change CV and an injection pressure change CP in the injection process and the boosting pressure process of the above-described die-casting machine. In the FIG. 11, the injection cylinder device 95 is advanced at a low speed VL at the start and is advanced at a high speed VH from a time period t1. The injection cylinder advance is restrained by a filling pressure of the molten material 92 in accordance with completion of filling the mold cavity 91 and is stopped at time period t3, at which the injection cylinder device 95 reaches a stroke end thereof. During the advance of the injection cylinder device 95, the boost cylinder 96 is actuated to boost the pressurization, so that the pressure applied to the molten material in the mold cavity 91 reaches PH.

For controlling sequence (switch from the injection process to the boosting pressure process) of the injection cylinder device 95 and the boost cylinder device 96, a sequence valve method where the switch is carried out by detecting the change in the injection pressure, and limit switch method where the switch is carried out by detecting the advanced position of the injection plunger are adopted.

In the above limit switch method, following hydraulic circuit is employed.

In FIG. 12, the injection cylinder device 95 has connected thereto an injection hydraulic circuit 114 including a check valve 111, an injection speed controlling valve 112 and an accumulator 113. The boost cylinder device 96 has connected thereto a boost hydraulic circuit 117 including a pilot-operation boost control valve 116 which is opened and shut by an electric switching valve 115 and an accumulator 113.

The electric switching valve 115 is designed to open the boost control valve 116 when the pressure of the injection hydraulic circuit 114 exceeds a predetermined boost starting pressure. Accordingly, when the injection cylinder device 95 starts advancing by operating the injection speed control valve 112 to inject the molten material 92 and the filling pressure is increased in accordance with completion of the molten material into the mold to reach the predetermined boost starting pressure, the electric switching valve 115 is operated to open the boost control valve 116, thereby initiating advance of the boost cylinder device 96 to boost pressurization. A pilot check valve 97 is connected to a meter-out side of the boost cylinder device 96. The pilot check valve 97 is opened before boosting pressurization to lessen a hydraulic resistance of the back-pressure side of the boost cylinder device 96, and is shut after the injection cylinder device 95 is retreated.

FIG. 13 specifically shows the injection cylinder device 95 and the boost cylinder device 96.

The injection cylinder device 95 has an injecting piston 95A thereinside, and the injecting piston 95A is advanced by a hydraulic pressure of hydraulic fluid supplied to a back side of the injecting piston 95A by the injection hydraulic circuit 114. The flow of the hydraulic fluid of the injection hydraulic circuit 114 is controlled by the injection speed control valve 112, thereby switching the advance and halt of the injecting piston 95A and controlling advance speed of the injecting piston 95A.

The boost cylinder device 96 has an boosting piston 96A thereinside, and the boosting piston 96A is advanced by a hydraulic pressure of a hydraulic pressure of hydraulic fluid supplied to a back side of the boosting piston 96A by the boost hydraulic circuit 117, thereby pressurizing the injecting piston 95A from the back side thereof through a intermediate member 95B of the injection cylinder device 95. The hydraulic oil from the boost hydraulic circuit 117 is controlled to flow on and off by the boost control valve 116, thereby switching advance and halt of the boosting piston 96A.

The boost control valve 116 is opened and shut by the electric switching valve 115. A solenoid valve and the like switching in accordance with filling pressure are employed as the electric switching valve 115.

[Problem in the Conventional Two-Stage Die-Casting Machine]

Incidentally, in the above-described conventional two-stage die-casting machine, there is a disadvantage that the injection speed is not stable in injecting a highly viscous molten material such as a semi-solid molten material, thereby deteriorating the quality of the die-casting product. The disadvantage is described below with reference to FIG. 14.

The FIG. 14 shows an injection speed change CV and an injection pressure change CP in injecting highly viscous molten material.

In the FIG. 14, the injecting piston of the injection cylinder device is smoothly advanced at a determined speed of 0.7 m/s until the head of the molten material reaches around entrance of the gate portion of the mold. However, a great change in gate resistance is caused in injecting the molten material into the mold cavity by the boost cylinder device during a stroke shown as S, since a high injection power is necessary after the head of the molten material passes the entrance of the gate portion.

Accordingly, an irregular fluctuation shown as Pp is caused in casting pressure, and an inappropriate change shown as Vp, which is not predetermined, is occurred in the injection speed. The quality of the diecasting product is influenced by the change in the injection speed.

SUMMARY OF THE INVENTION

The object of the present invention is to provide a method for controlling injection in a die-casting machine and an apparatus therefor, where an injection speed of an injection cylinder device is stable even when a highly viscous molten material is injected to produce a die-casting product, thereby obtaining a high-quality die-casting product.

[Basic Structure]

A method for controlling injection in a die-casting machine according to the present invention employs a die-casting machine having a casting mold with a gate portion for molten material to flow in, an injection plunger for injecting the molten material into the casting mold, an injection cylinder device for driving the injection plunger, an injecting piston provided to the injection cylinder device, a boost cylinder device for boosting pressure applied to hydraulic fluid supplied to the injection cylinder device, a boosting piston provided to the boost cylinder device, and a hydraulic channel for discharging the hydraulic fluid from a back-pressure side of the boost cylinder device. The method is characterized in having the steps of: providing an injection cylinder flow-control valve to the injection cylinder device for controlling a speed and a position of the injecting piston, a boost cylinder control valve to the boost cylinder device for operating the boost cylinder device, an open-shut valve for opening and shutting the hydraulic channel and a boost cylinder flow-control valve for regulating the flow of the hydraulic fluid discharged from the boost cylinder device; when a highly viscous molten material is injected into the casting mold, driving the injection cylinder device by actuating the injection cylinder flow-control valve while shutting the hydraulic channel by the open-shut valve and the boost cylinder flow-control valve; when the injection plunger reaches approximately an entrance of the gate portion of the casting mold, driving the boost cylinder device to assist the drive of the injection cylinder device by actuating the boost cylinder control valve and the boost cylinder flow-control valve for discharging the hydraulic fluid from the boost cylinder device while controlling the flow of the hydraulic fluid; and when the molten material is completed to be filled in the casting mold, boosting the pressure applied to the molten material in the casting mold by the boost cylinder device.

And according to an apparatus for controlling injection in a die-casting machine of the present invention, the die-casting machine includes a casting mold with a gate portion for molten material to flow in, an injection plunger for injecting molten material into the casting mold, an injection cylinder device for driving the injection plunger, an injecting piston provided to the injection cylinder device, a boost cylinder device for boosting pressure applied to hydraulic fluid supplied to the injection cylinder device, a boosting piston provided to the boost cylinder device, and a hydraulic channel for discharging the hydraulic fluid from a back-pressure side of the boost cylinder device. The apparatus is characterized in including an injection cylinder flow-control valve for controlling a speed and a position of the injecting piston, a boost cylinder control valve for driving the boost cylinder device, an open-shut valve provided to the hydraulic channel for opening and shutting the hydraulic channel and a boost cylinder flow-control valve provided to the hydraulic channel for controlling a flow of the hydraulic fluid discharged from the boost cylinder device through the hydraulic channel. The apparatus is further characterized in that the open-shut valve shuts the hydraulic channel when a highly viscous molten material is filled into the casting mold and the boost cylinder flow-control valve shuts the hydraulic channel when the highly viscous molten material is filled into the casting mold, and regulates the hydraulic channel so that the flow of the hydraulic fluid is controlled to be discharged through the hydraulic channel while the injection cylinder device is in operation.

[Basic Operation]

According to the present invention, following operations are carried out when the die-casting products are manufactured by injecting the highly viscous molten material into the casting mold.

The open-shut valve is closed in advance to shut the hydraulic channel of the back-pressure side of the boost cylinder device. Also, the boost cylinder flow-control valve is closed to shut the hydraulic fluid. The injection cylinder device is driven by actuating the injection cylinder flow-control valve to inject the highly viscous molten material into the casting mold by the injection plunger, thereby conducting injection process.

During the injection process, the boost cylinder device is driven by the boost cylinder control valve. At the same time, the boost cylinder flow-control valve is controlled to regulate the hydraulic fluid discharged through the hydraulic channel, thereby controlling an advance speed of the boost cylinder device and the injection plunger. At this stage, though injection resistance is increased when the highly viscous molten material is reached to the gate portion, no inappropriate fluctuation in injection pressure and speed of injection plunger is caused since assistance can be obtained from the boost cylinder device controlled by the boost cylinder flow-control valve.

When the injection plunger is further advanced to reach a filling completion position (completion of injection process) of the molten material in the casting mold, the open-shut valve is opened and rapidly shifted to an open degree sufficiently larger than the boost cylinder flow-control valve so that the flow is controlled to be in accordance with an ordinary boosting pressure process.

On the contrary, when a die-casting products is manufactured by injecting ordinary molten material (not highly viscous), the hydraulic channel can be made open by opening the open-shut valve in advance so that a structure substantially similar to ordinary die-casting machine can be created. Accordingly, ordinary injection process by the injection cylinder device and boosting pressure process by the boosting cylinder device are carried out. In other words, since the hydraulic channel of the back side of the boost cylinder device is open, the fluid resistance of the back-pressure side of the boost cylinder is small enough to allow appropriate boost to the injection cylinder device ordinarily.

As described above, the open-shut valve is opened to conduct ordinary injection process and boosting pressure process in manufacturing die-casting product using ordinary molten material. And, the boost cylinder device is employed in the injection process as well as in the boosting pressure process in manufacturing die-casting product using highly viscous molten material. In other words, the hydraulic fluid is discharged from the boost cylinder device thereby allowing the boost cylinder device to assist the inject plunger while the speed thereof being controlled. Accordingly, no inappropriate change in injection speed is caused and the casting pressure can be maintained within a predetermined appropriate range, thereby causing no deterioration in the quality of the die-casting products.

[Optional Structure]

In the present invention, the position and the speed of the injecting piston may be feed-back controlled by controlling a back-pressure of the injection cylinder device with a back-pressure control valve employing a high-speed responsive electrohydraulic servovalve provided to hydraulic fluid discharging channel of the injection cylinder device, and the position and the speed of the injecting piston may be feed-back controlled by controlling the back-pressure of the boost cylinder device with a back-pressure control valve employing a high-speed responsive electrohydraulic servovalve provided to hydraulic fluid discharging channel of the boost cylinder device.

According to the above, the advancement of the injection cylinder device and the boost cylinder device is appropriately controlled in the injection process, which is effective in manufacturing a high-quality die-casting products.

Further, a ratio (S2/S1) of a cylinder stroke (S2) of the boost cylinder device relative to a cylinder stroke (S1) of the injection cylinder device may be set larger than one fourth, which conventional cylinder strokes employed. Accordingly, the cylinder stroke of the boost cylinder device can be set longer and advantageous injection filling power can be obtained in filling the casting mold with highly viscous molten material.

The open-shut valve and the boost cylinder flow-control valve may be composed of a single high-speed responsive electrohydraulic servovalve. With this structure, the number of parts of the die-casting machine can be reduced since only one valve having a plurality of functions is provided.

DETAILED DESCRIPTION OF PREFERRED EMBODIMENT(S)

A preferred embodiment of the present invention will be described below with reference to drawings.

Since the present embodiment is conducted by modifying a controlling method of a conventional die-casting machine and main components of the conventional die-casting machine such as casting mold and injection plunger can be appropriated, the description of the specific components will be omitted. Accordingly, an injection cylinder device, boost cylinder device and hydraulic circuit for providing hydraulic fluid to the injection cylinder device and the boost cylinder device, which are different from the conventional components, will be described below.

[Description of Hydraulic Circuit]

Figure 1:
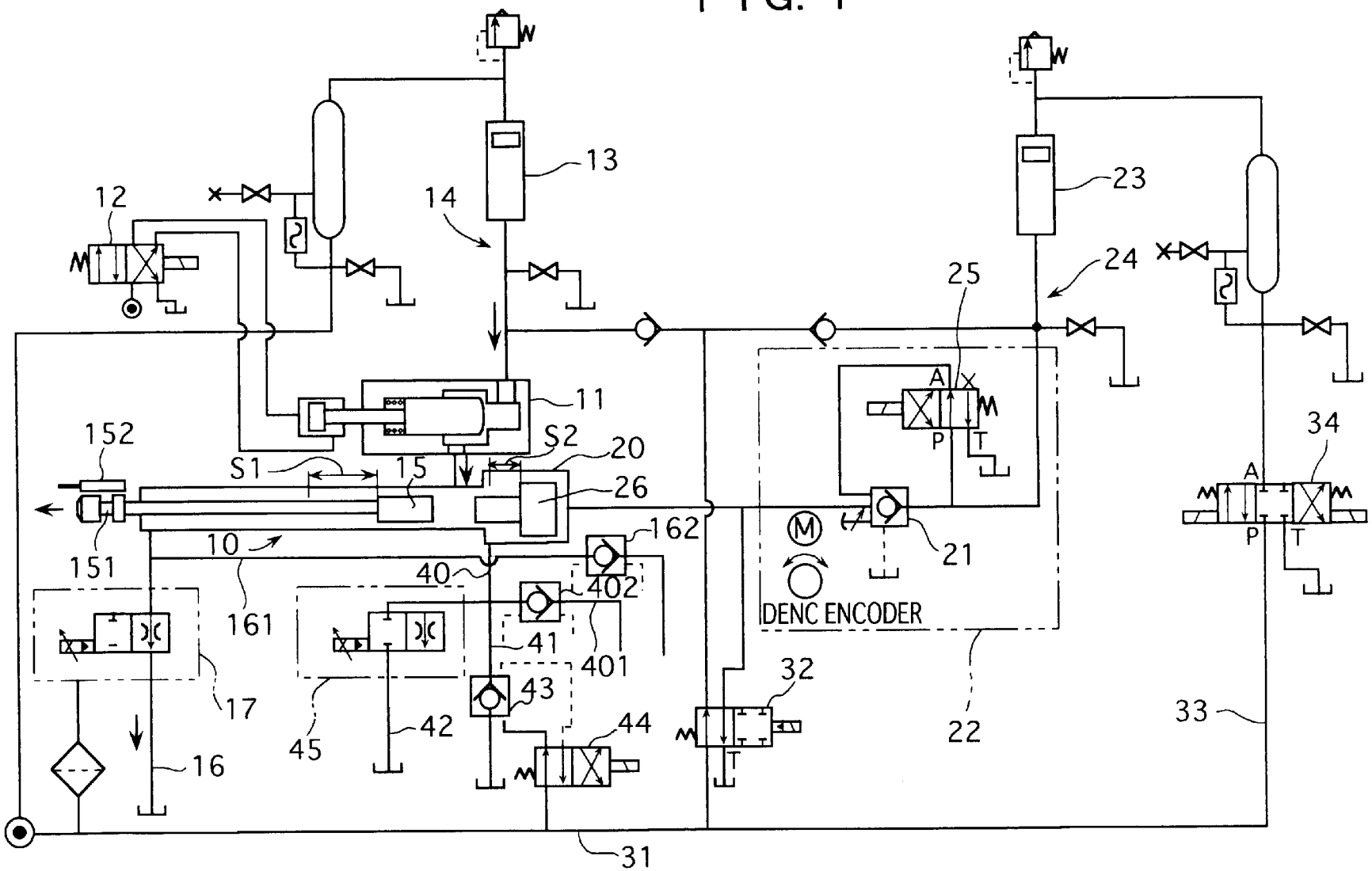
FIG. 1 is a circuit diagram showing a preferred embodiment of an apparatus for controlling injection of a die-casting machine according to the present invention.

In FIG. 1, an injection hydraulic circuit 14 which extends through a pilot check valve 11 for switching injection movement to injection accumulator 13 is connected to an injection cylinder device 10. The check valve 11 controls opening and shutting by an open-shut electroswitching valve 12. After the check valve 11 is opened by operating the electroswitching valve 12, hydraulic fluid from the injection accumulator 13 is supplied to the injection cylinder device 10 to advance an injecting piston 15.

The check valve 11 stops the flow of the hydraulic fluid from the injection accumulator 13 to the injection cylinder device 10. When there is no differential pressure between an inlet side and an outlet side, a valve body is moved by a spring provided inside, to prevent backflow of the hydraulic fluid in boosting pressure process.

The injection cylinder device 10 has a hydraulic fluid discharging channel 16 to which an injection cylinder flow-control valve 17 is connected.

The injection cylinder flow-control valve 17 is composed of a high speed responsive large-flow servovalve, of which open degree can be regulated to narrow the hydraulic discharging channel 16 when the injection cylinder device 11 is advanced to apply a back-pressure to the injecting piston 15, so that an advance speed and an advance position of the injecting piston 15 can be controlled.

The injecting cylinder 10 has a boost cylinder device 20 for boosting a pressure applied on the hydraulic fluid supplied to the injection cylinder 10.

A ratio (S2/S1) of a cylinder stroke (S2) of the boost cylinder device 20 relative to a cylinder stroke (S1) of the injection cylinder stroke 10 is set larger than one fourth (¼).

A boosting time control circuit 22 having a boost cylinder control valve 21 for controlling flow supplied to the boost cylinder device is connected to the boost cylinder device 20, and the boosting time control circuit 22 is connected to a boost hydraulic circuit 24 extending to a boost accumulator 23.

The boosting time control circuit has the boost cylinder control valve 21 and an electric direction switching valve 25.

The boost cylinder control valve 21 has a flow-control two-way valve (as a check valve) at an end of a main spool (not shown), and a stroke-controllable (i.e. flow-controllable) screw and a geared motor having an digital encoder (DENC) at the other end of the main spool.

Accordingly, the boost cylinder control valve 21 functions as a flow-control valve as well as a check valve and a two-way valve. In other words, in injecting the molten material before boosting pressure, the boost cylinder control valve 21 is shut by operating the electric direction switching valve 25, thereby stopping the supply of the hydraulic fluid from the boost accumulator 23 and preventing backflow from the boost cylinder device 20.

On the other hand, in boosting pressure applied to the molten material filled inside the casting mold, the boost cylinder control valve 21 is opened by operating the electric direction switching valve 25 and an open degree position of the main spool is optionally controlled, so that the hydraulic fluid from the boost accumulator 23 is supplied to the boost cylinder device 20 and the boosting piston 26 of the boost cylinder device 20 is advanced.

A hydraulic fluid supplying channel 31 from hydraulic source is connected to the injection accumulator 13 and the boost accumulator 23 respectively to supply high-pressured hydraulic fluid to each of the accumulator. An electric accumulator filling switch valve 32 is provided to an intermediate part of the hydraulic supplying channel 31, so that the supply of the hydraulic fluid to respective accumulators 13 and 23 is switched on and off.

The boost accumulator 23 has connected thereto a branch channel 33 from the hydraulic supplying channel 31, and an electric casting pressure control valve 34 is provided at an intermediate part of the hydraulic supplying channel 31.

The back-pressure of the boost accumulator 23 is increased by introducing hydraulic fluid from the hydraulic source by the casting pressure control valve 34, thereby increasing a maximum hydraulic pressure of the boost hydraulic circuit 24. Accordingly, a maximum casting pressure applied to the boost cylinder device 20 can be increased. On the contrary, when the hydraulic fluid is discharged by the casting pressure control valve 34 to lower the back-pressure of the boost accumulator 23, the maximum hydraulic pressure of the boost hydraulic circuit 24 is lowered, so that the maximum casing pressure applied to the boost cylinder device 20 is relaxed.

The injection cylinder device 10 has an encoder 152 for detecting an advance position of an injection plunger 151, so that a stroke position in injection process can be directly detected.

A controller (not shown) is provided to receive signals from the respective sensors and to control the operation of respective valves etc. The controller includes a conventional computer system and programmable controller or the like, and operates respective valves etc. at a preset process according to a predetermined processing software program to conduct injection process and boosting pressure process.

Figure 2:
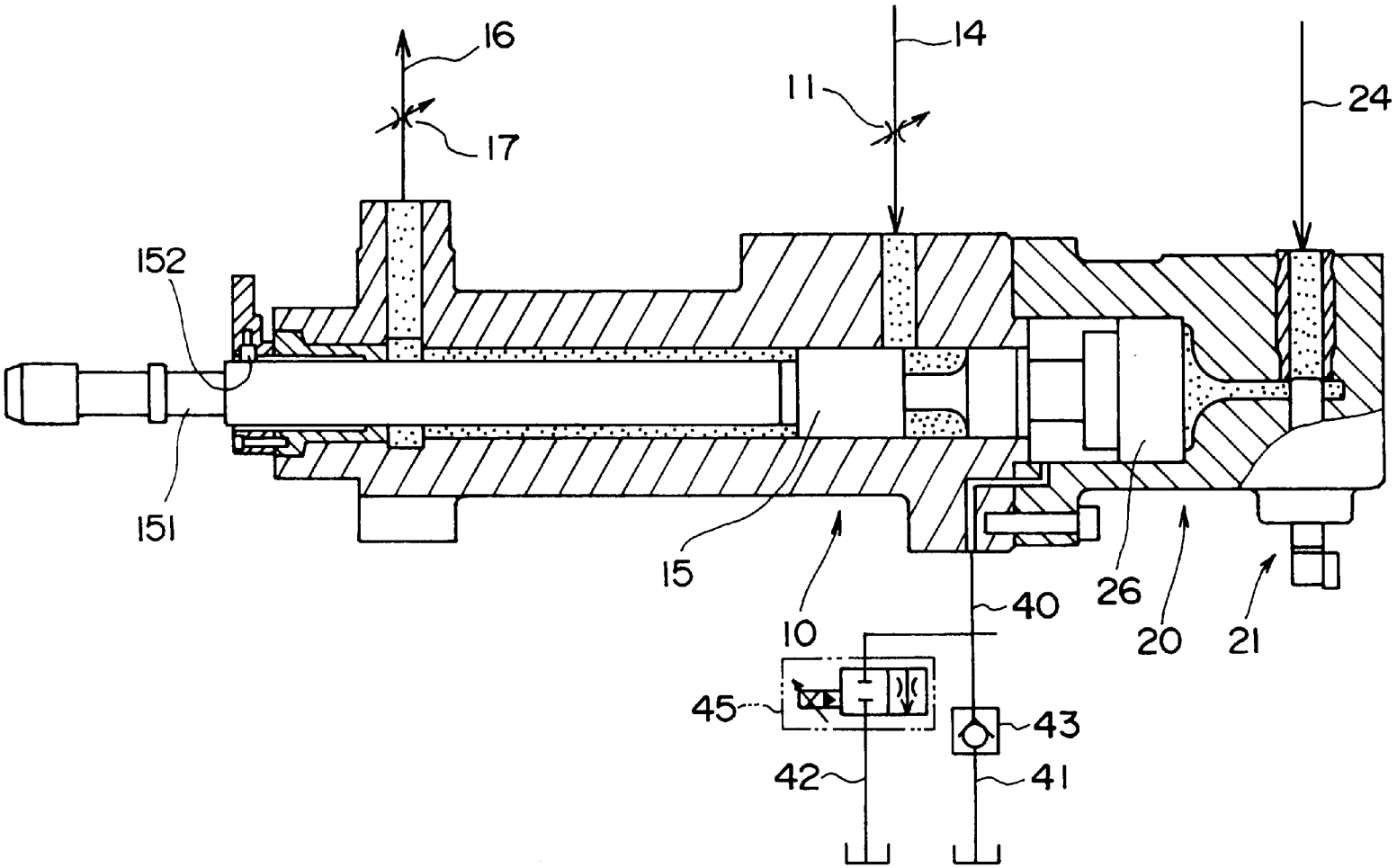
FIG. 2 is a sectional view showing a cylinder device according to the aforesaid embodiment.

As shown in FIG. 2, the boosting cylinder device 20 has connected thereto an end of a main channel 40 for discharging the hydraulic fluid from a meter-out side thereof. On the other side of the main channel 40, first channel 41 for discharging the hydraulic fluid from the boost cylinder device 20 to lower a fluid resistance on a back-pressure side thereof, and second channel juxtaposed along the first channel 41 are connected. The channels 40 to 42 compose a hydraulic discharging channel.

The first channel 41 is used in manufacturing die-casting product by injecting ordinary (not highly viscous) molten material into casting mold. An open-shut valve 43 for opening and shutting the channel is provided at an intermediate part of the first channel 41.

The open-shut valve 43 is a pilot check valve, which is opened and shut by a signal from an operation valve 44 (see FIG. 1). The open-shut valve 43 shuts the first channel 41 in manufacturing die-casting product by filling the casting mold with a highly viscous molten material, and opens the first channel 41 when die-casting products is manufactured by filling the casting mold with an ordinary (not highly viscous) molten material.

The second channel 42 has a boost cylinder flow-control valve 45. The boost cylinder flow-control valve 45 is a high-speed responsive electrohydraulic servovalve, which controls flow of the hydraulic fluid discharged from the boost cylinder device 29 through the second channel 42. The encoder 152 provided at a distal end of the injection cylinder device 10 detects the advance position of the injection plunger 151 to feed-back control the injection plunger 151 at a predetermined speed.

Figure 3:
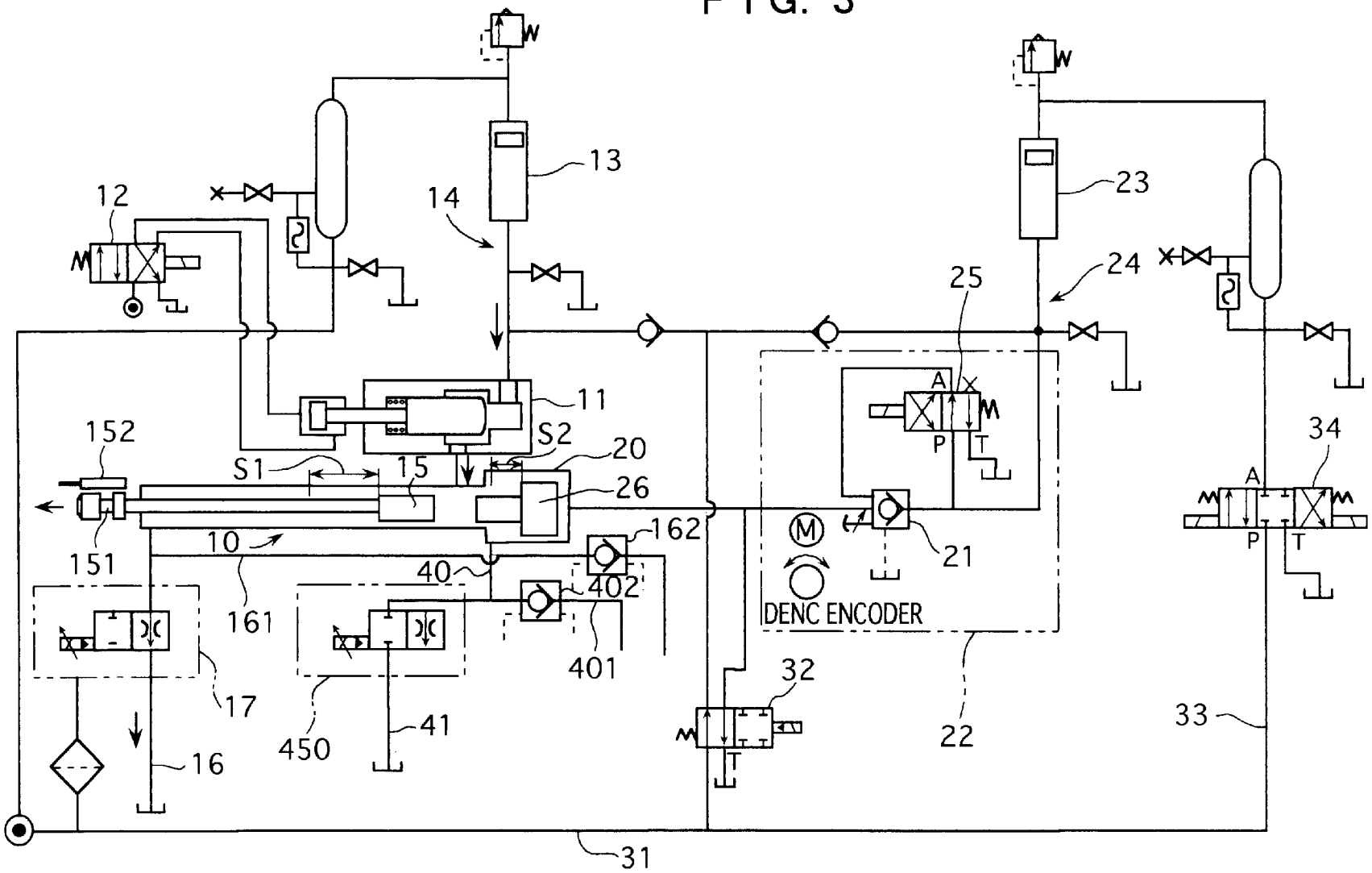
FIG. 3 is a circuit diagram showing another preferred embodiment of the apparatus for controlling injection of the die-casting machine according to the present invention.

As shown in FIG. 3, the open-shut valve 43 and the boost cylinder flow-control valve 45 of the present embodiment may be composed of a single high-speed responsive electrohydraulic servovalve 450.

In this case, the high-speed electrohydraulic servovalve 450 functions as both of the open-shut valve 43 and the boost cylinder flow-control valve 45 and has the same basic structure as the boost cylinder flow-control valve 45. The flow of the servovalve 450 is larger than the boost cylinder control valve 21. The servovalve 450 is provided to the first channel 41, and the second channel 42 is not disposed in FIG. 3.

Further, the boost cylinder flow-control valve 45 may be composed of a high-speed responsive electrohydraulic proportional flow-control valve.

As shown in FIG. 1, an end of a branch 161 of which the other end is connected to an injecting piston retreating circuit (not shown) is connected to the hydraulic fluid discharging circuit 16. A pilot check valve 162 is disposed to the branch 161. The injecting piston 15 is retreated by opening the pilot check valve 162. An end of a branch 401 of which the other end is connected to a boosting piston retreating circuit (not shown) is connected to the hydraulic main channel 40. A pilot check valve 402 is disposed to the branch 401. The boosting piston 26 is retreated by opening the pilot check valve 402.

[Description of Specific Process-Highly Viscous Molten Material]

Next, a preferred embodiment of the method for controlling injection in the die-casting machine according to the present invention will be described with reference to FIG. 4 to FIG. 9.

Figure 4:
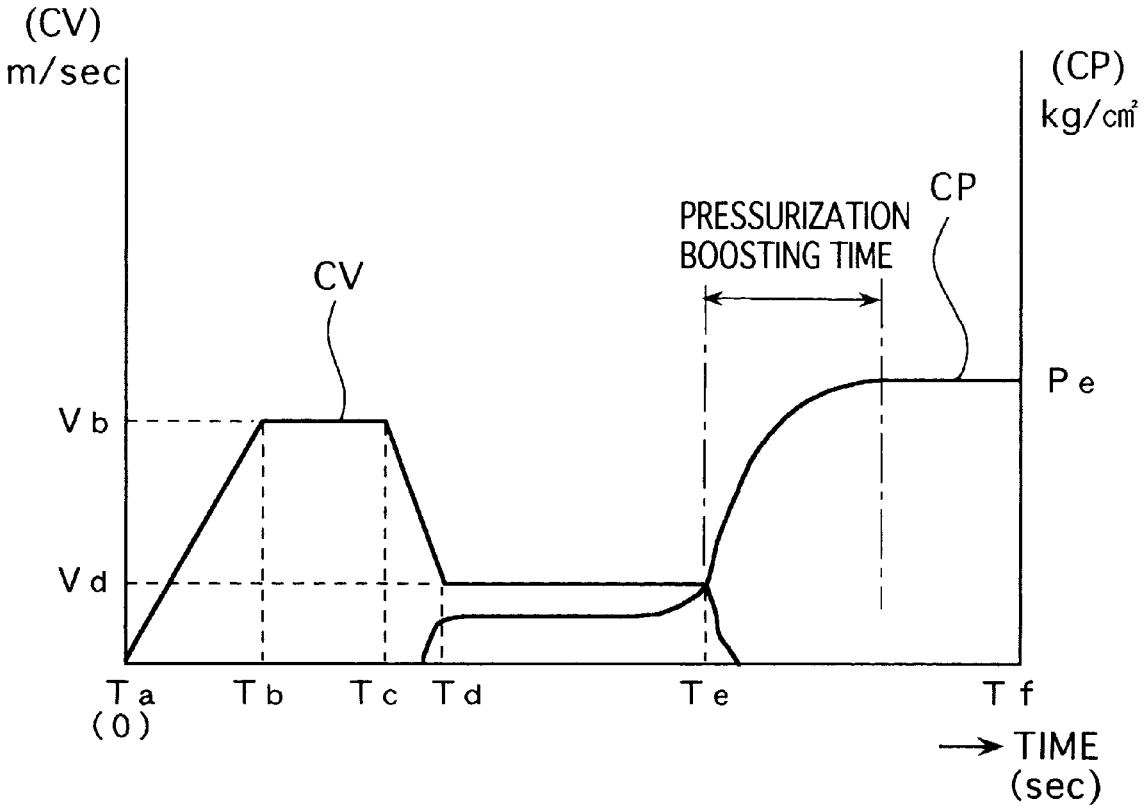
FIG. 4 is a graph showing an injection and boosting pressure process in a preferred embodiment of a method for controlling injection of the die-casting machine according to the present invention.

FIG. 4 is a graph showing injecting process and boosting pressure process. The injection cylinder device 10 and boosting cylinder device 20 is controlled so that the injection speed and the injection pressure are set as shown in an injection speed change Cv and an injection pressure change Cp shown in the graph.

First, the first channel 41 is shut by the open-shut valve 43 in advance as shown in FIG. 1 for manufacturing die-casting products by filling the casting mold with highly viscous molten material. The second channel 42 is also shut by the boost cylinder flow-control valve 45 and the injection cylinder flow-control valve 17 is narrowed at a predetermined open degree.

Consequently, the check valve 11 is opened to supply a hydraulic fluid from the injection accumulator 13 to injection cylinder device 10, thereby advancing the injection plunger 151. Then, the highly viscose molten material is injected to the injection plunger 151 to initiate injecting process. By controlling the open degree of the injection cylinder flow-control valve 17, the injecting piston 15 is accelerated to advance so that a section injection speed Cv from Ta(0) to Th reaches Vb. Consequently, the injecting piston 15 is advanced at a constant speed of Vb at the section from Th to Tc, and is slowed down to Vd at the section from Tc to Td.

Figure 5:
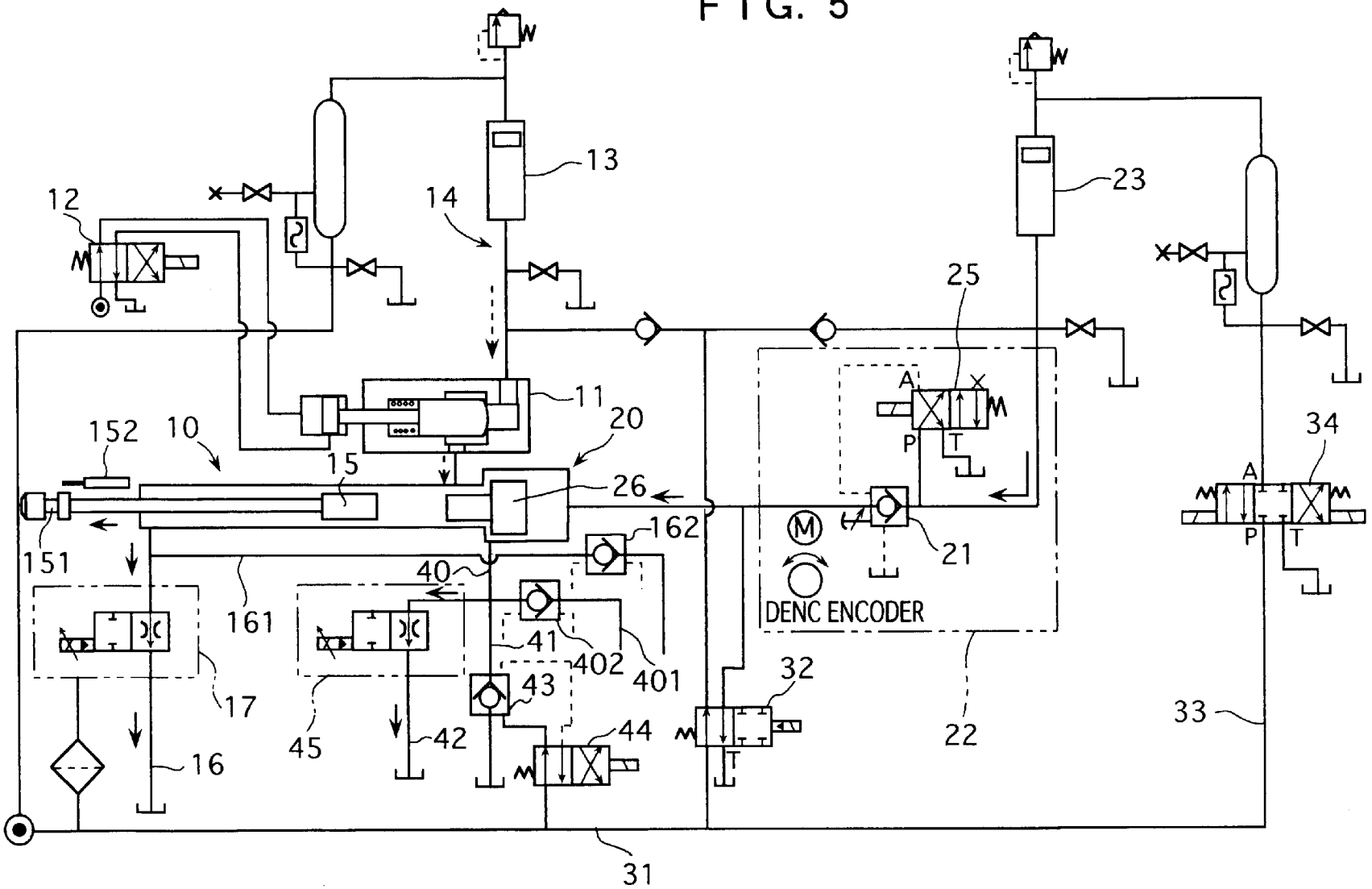
FIG. 5 is a circuit diagram showing boosting pressure process in filling a highly viscous molten material into a casting mold in the aforesaid embodiments of the apparatus.

As shown in FIG. 5, when the injection speed of the injecting piston 15 is slowed down to Vd and the injecting piston 15 reaches a position to inject the molten material in an injection sleeve into or around a cavity of the casting mold (i.e. a gate position for the injection plunger 151 to initiate filling the casting mold with the molten material), the check valve 11 is shut by the open-shut electroswitching valve 12 to stop injection process and a back-pressure braking of the injection plunger 151 is completely released.

Consequently, the speed and the position of the boost cylinder flow-control valve 45 is controlled as set in the software program. At the same time, the boost cylinder control valve 21 is opened by the electric direction switching valve 25 so that the open degree of the boost cylinder control valve 21 reaches a predetermined value, thereby feed-back controlling the speed and the position of the boosting piston 26 by the boost cylinder flow-control valve 45. The injection cylinder flow-control valve 17 open-loop controls the speed of the injecting piston 15 so that the speed of the injecting piston 15 is larger than the speed of the boosting piston 26.

Accordingly, the hydraulic fluid from the boost accumulator 23 is supplied to the boost cylinder device 20 to boost the pressure applied to the injection plunger 151 from the back side of the injecting piston 15.

At this time, a part of the hydraulic fluid is discharged from the boost cylinder device 20 through the second channel 42 by narrowing, and changing thereafter, the open degree of the boost cylinder flow-control valve 45. Accordingly, the boosting piston 26 of the boost cylinder device 20 is advanced to conduct injection process and supplementary boosting pressure process.

However, since the flow of the hydraulic fluid is controlled when the hydraulic fluid is discharged from the boost cylinder device 20 through the second channel 42, the injecting piston is advanced to Te at a predetermined speed, as shown in FIG. 4.

Figure 6:
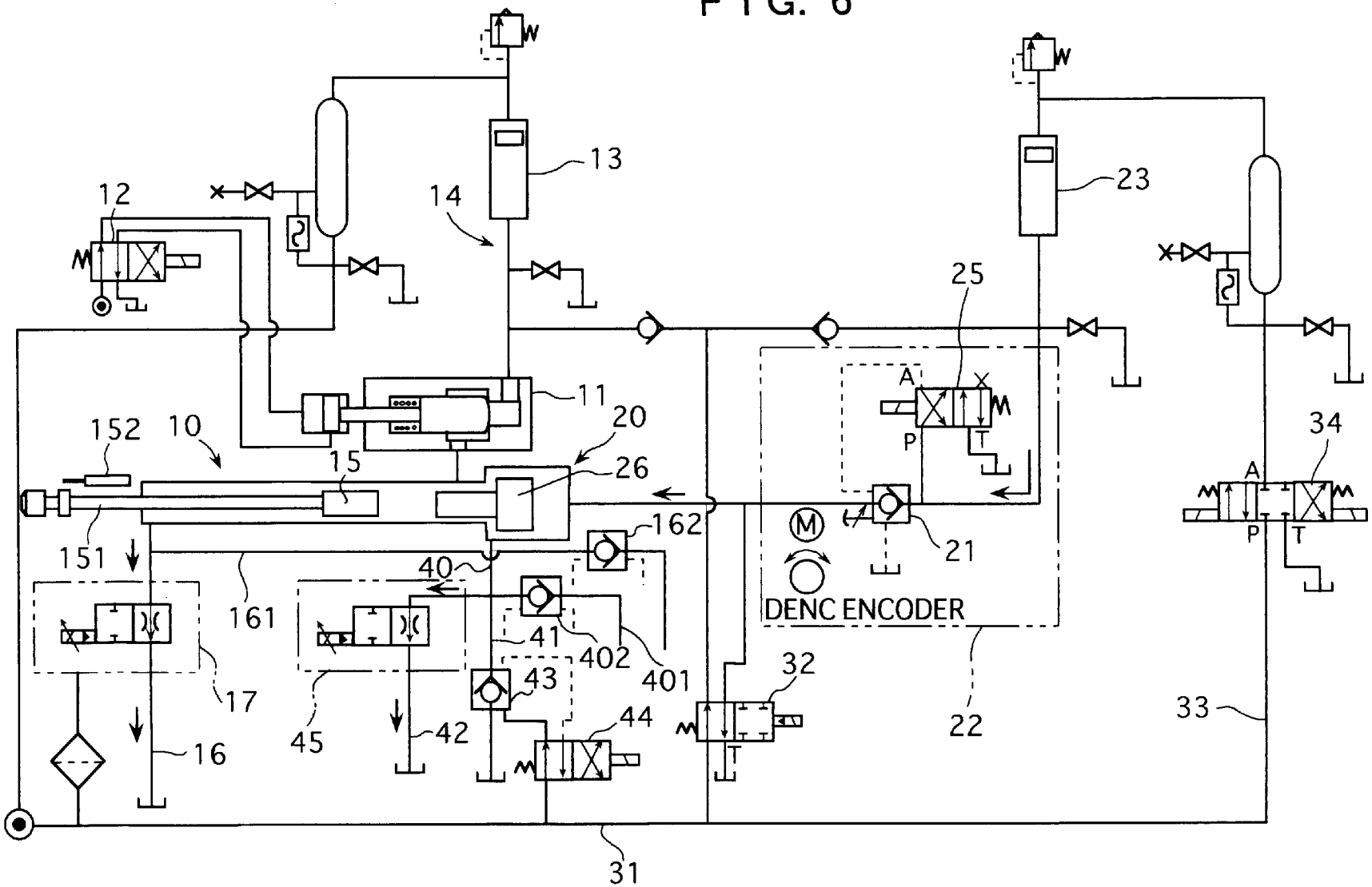
FIG. 6 is a circuit diagram showing boosting pressure process after the step shown in FIG. 5.

Further, as shown in FIG. 6, the hydraulic fluid for the boost cylinder device 20 is meter-in controlled by regulating the open degree of the boost cylinder control valve 21 and the open degree of the injection cylinder flow-control valve 17 and the boost cylinder flow-control valve 45 is controlled to be larger than the open degree of the boost cylinder control valve 21 (i.e. larger than the condition shown in FIG. 5) to meter-out control the injection cylinder device 10 and the boost cylinder device 20.

Accordingly, even when the advance of the injecting piston 15 is stopped, the injection pressure change Cp is rapidly raised until reaching the value of Pe by the boost cylinder device 20.

Since the pressure of the boost accumulator 23 is automatically controlled to a pressure corresponding to a preprogrammed necessary casting pressure, the boost completion pressure is controlled to be stable on every production cycle.

Figure 7:
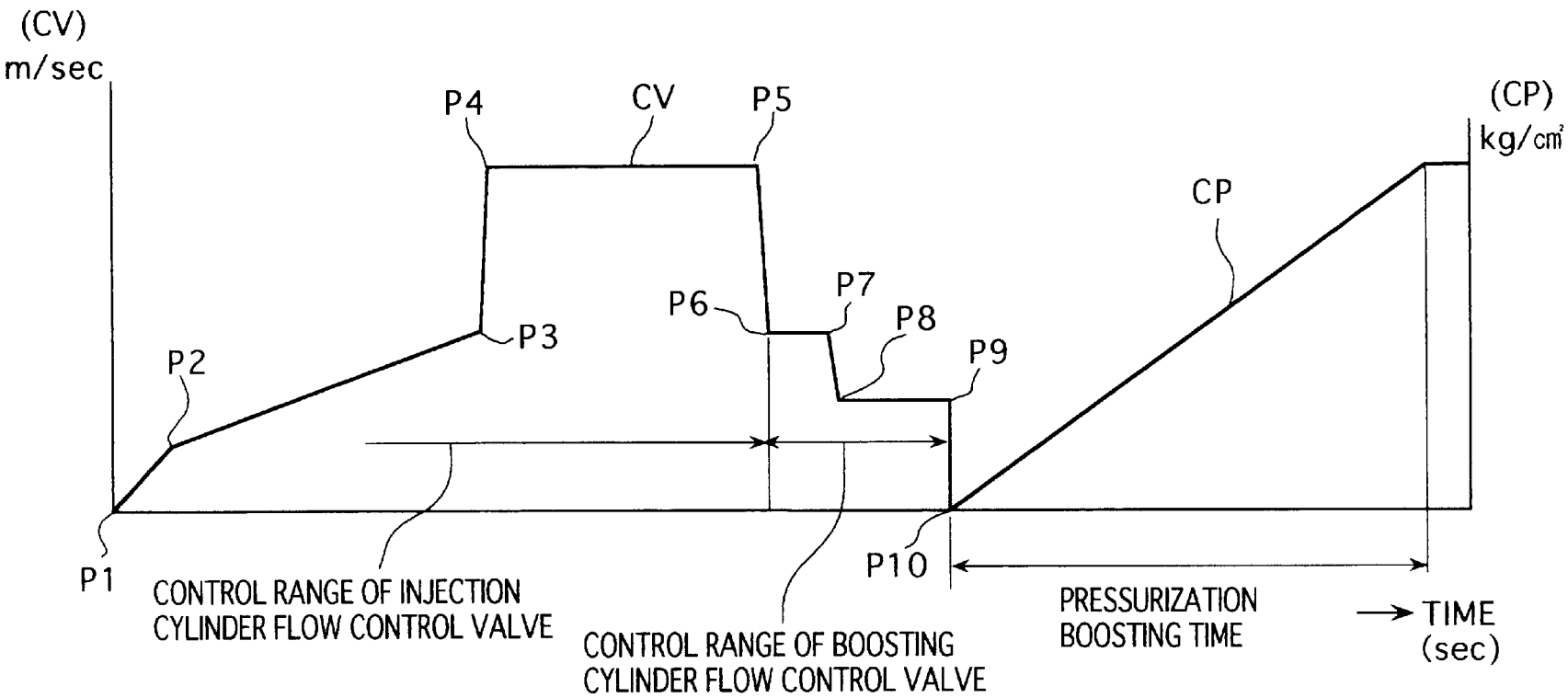
FIG. 7 is a graph showing an injection and boosting pressure process of another preferred embodiment of a method for controlling injection in the diecasting machine according to the present invention.

The present embodiment is not limited to control the injection cylinder device 10 and the boost cylinder device 20 in accordance with the injection speed change Cv and the injection pressure change Cp shown in FIG. 4, but the injection cylinder device 10 and the boost cylinder device 20 may be controlled according to an injection speed change Cv and an injection pressure change Cp shown in a graph of FIG. 7.

In FIG. 7, the injection speed change Cp is controlled by the injection cylinder flow-control valve 17 in a section from P1 to P6 and the injection speed change Cv is controlled by the boost cylinder flow-control valve 45 in a section from P6 to P10. The injection speed change Cv is controlled in a multi-stage by the boost cylinder flow-control valve 45. Immediately after the injection speed change Cv control by the boost cylinder flow-control valve 45 is terminated, the injection pressure change Cp is raised rapidly.

Figure 8:
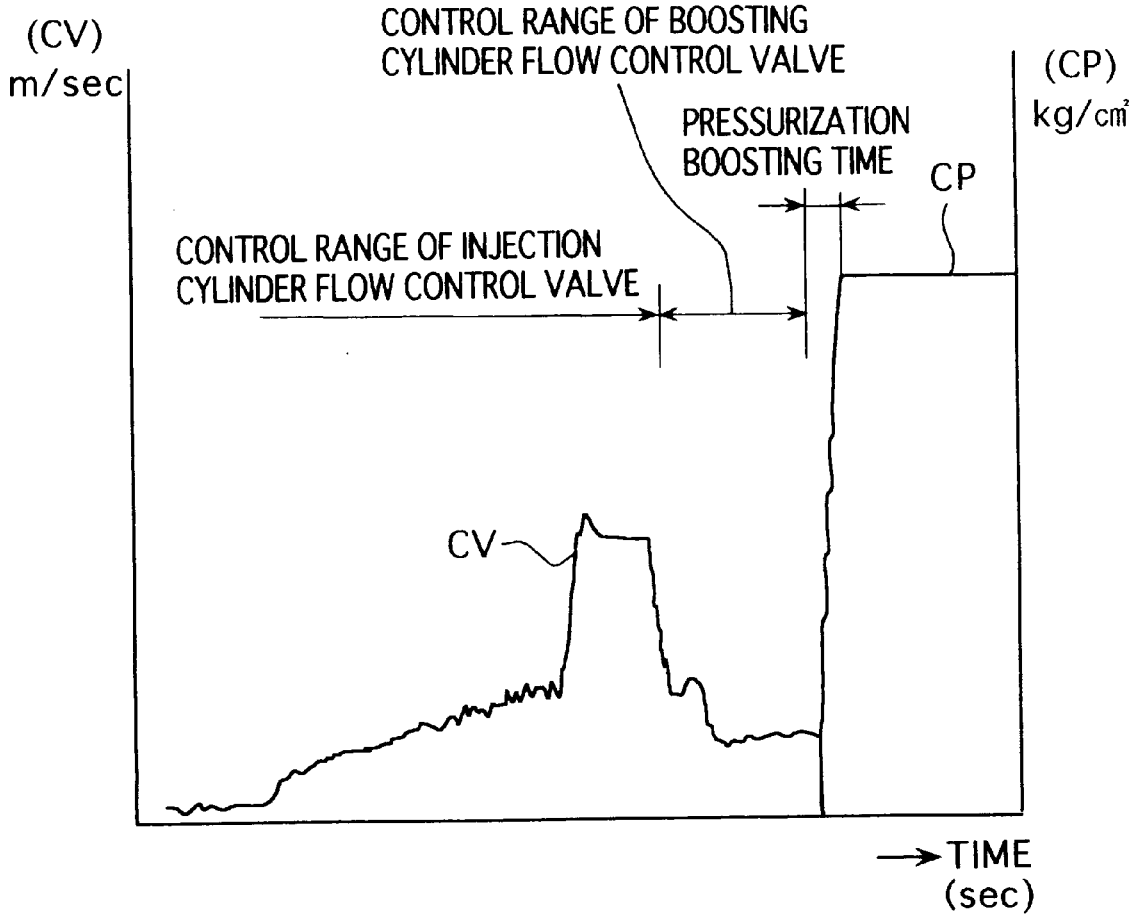
FIG. 8 is a graph showing experimental figures of an injection speed and an injection pressure measured by conducting injection and boosting pressure process according to the graph of FIG. 7.

Accordingly, the value of the actual injection speed change Cv and the injection pressure change Cp become the value shown in a graph of FIG. 8, and the waveform of the injection speed change Cv is not disturbed.

[Description of Specific Process-Ordinary Molten Material]

The specific process for manufacturing die-casting products by injecting ordinary molten material (not highly viscous) will be described below with reference to FIG. 9.

Figure 9:
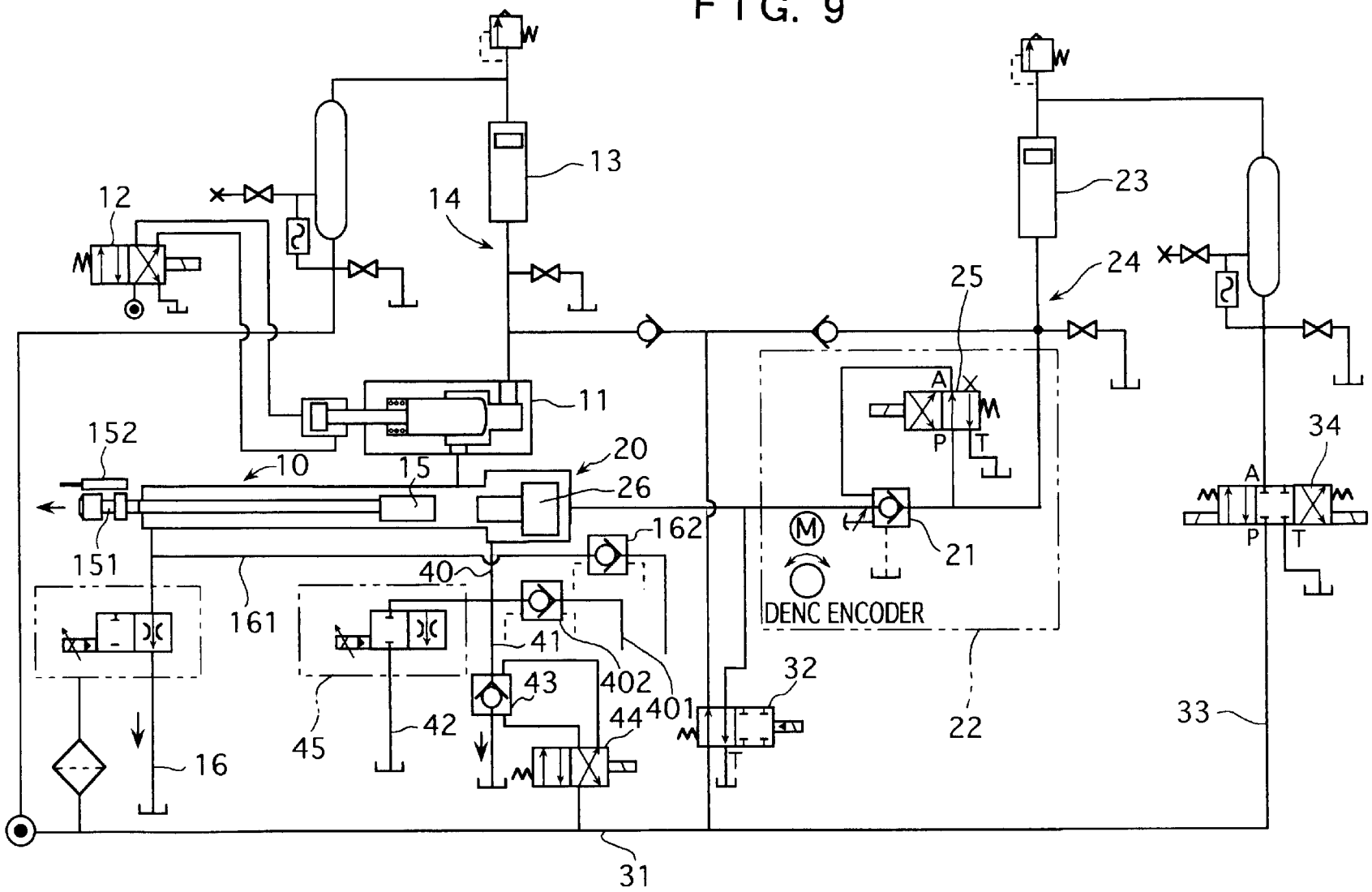
FIG. 9 is a diagram circuit showing a boosting pressure process in filling the casting mold with an ordinary (not highly viscous) molten material in the apparatus for controlling injection according to the aforesaid embodiments.
Figure 10:
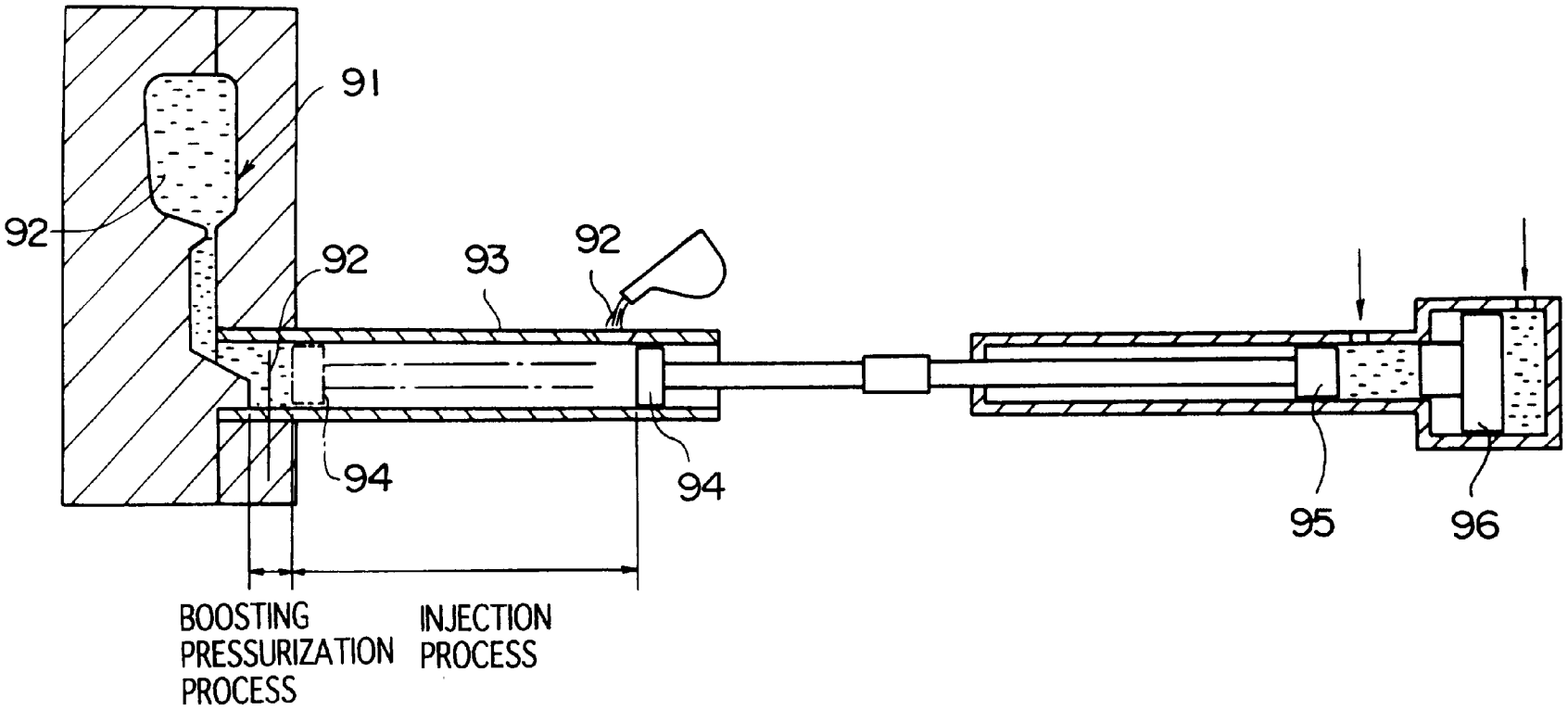
FIG. 10 PRIOR ART
FIG. 10 is a sectional view showing basic structure of a conventional die-casting machine.
Figure 11:
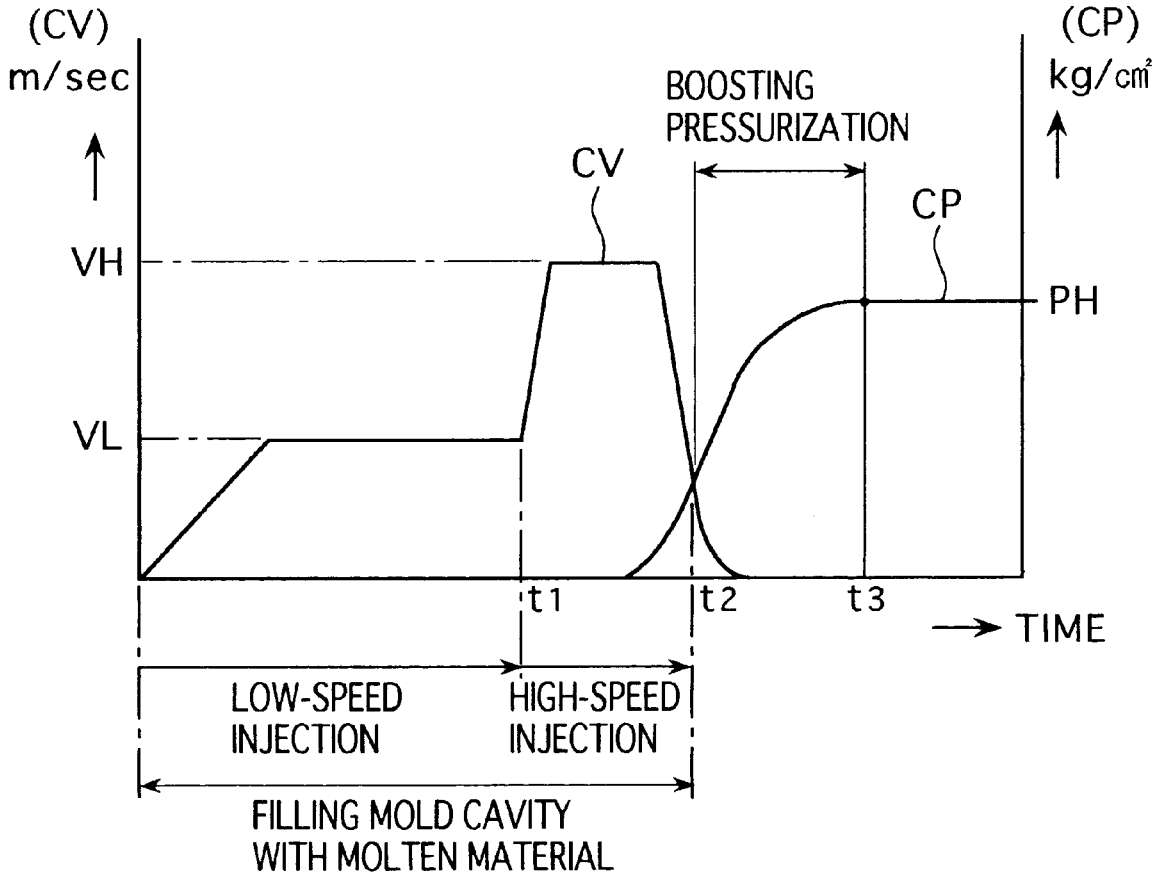
FIG. 11 PRIOR ART
FIG. 11 is a graph showing an injection and a boosting pressure process of the conventional die-casting machine.
Figure 12:
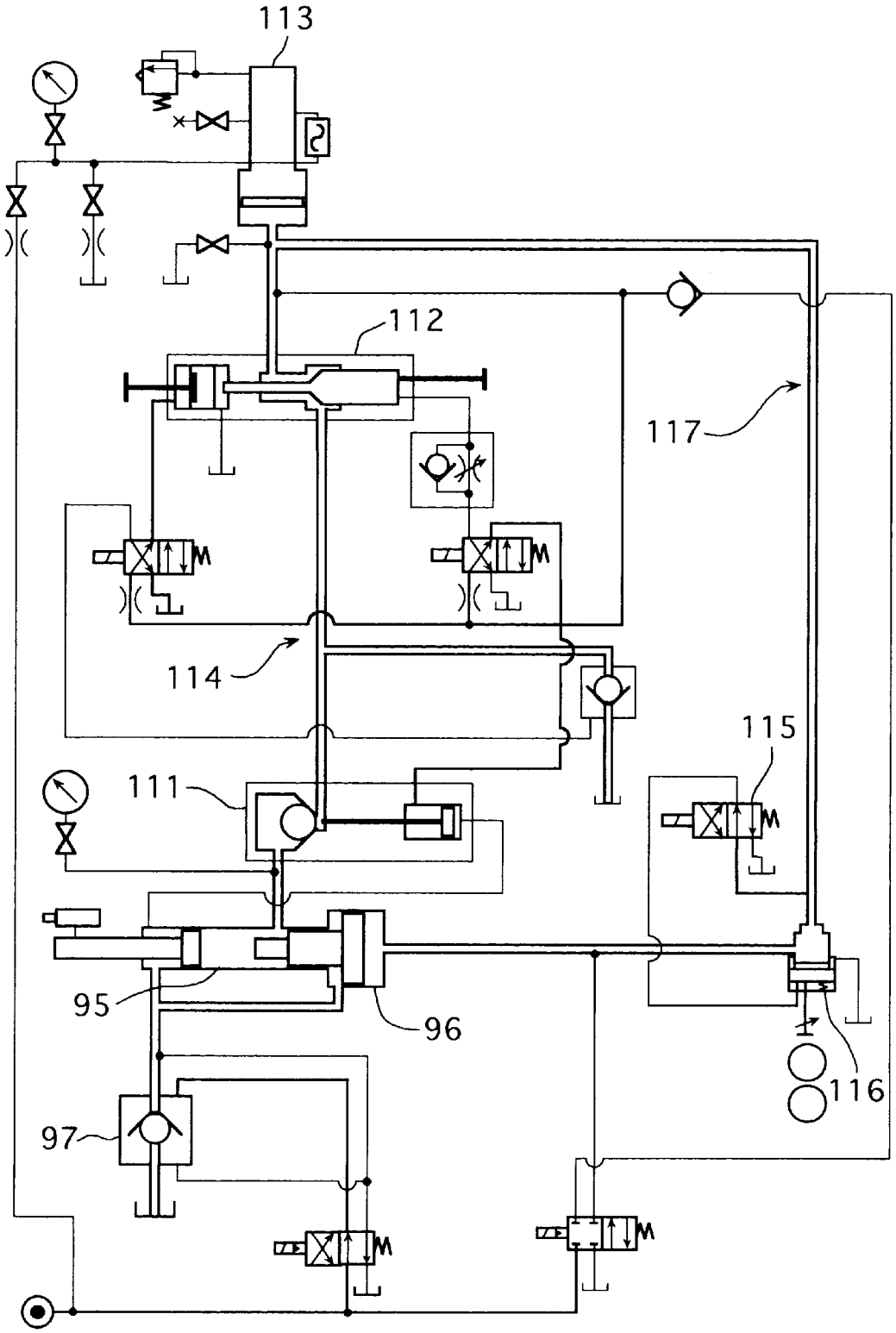
FIG. 12 PRIOR ART
FIG. 12 is a circuit diagram showing a hydraulic circuit of the conventional die-casting machine.
Figure 13:
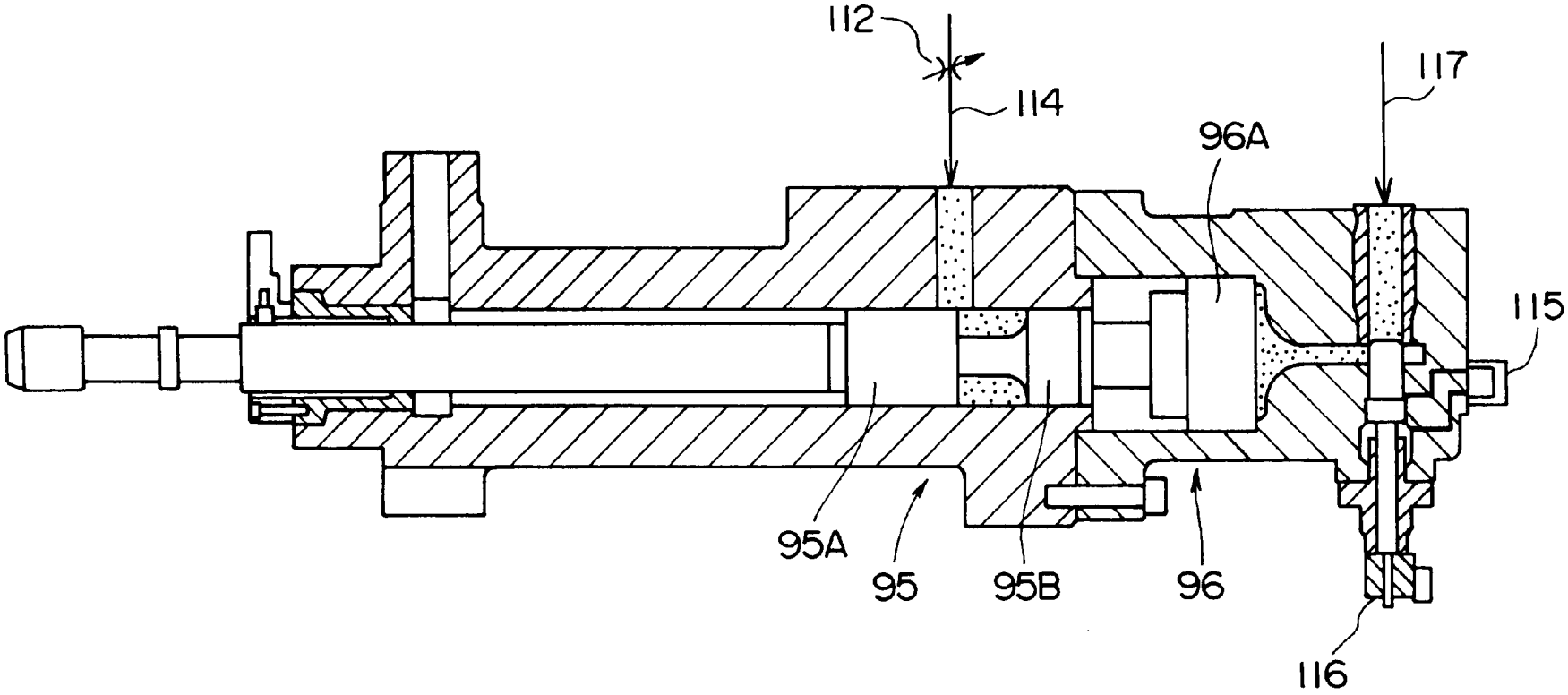
FIG. 13 PRIOR ART
FIG. 13 is a cross-sectional view showing a conventional cylinder device.
Figure 14:
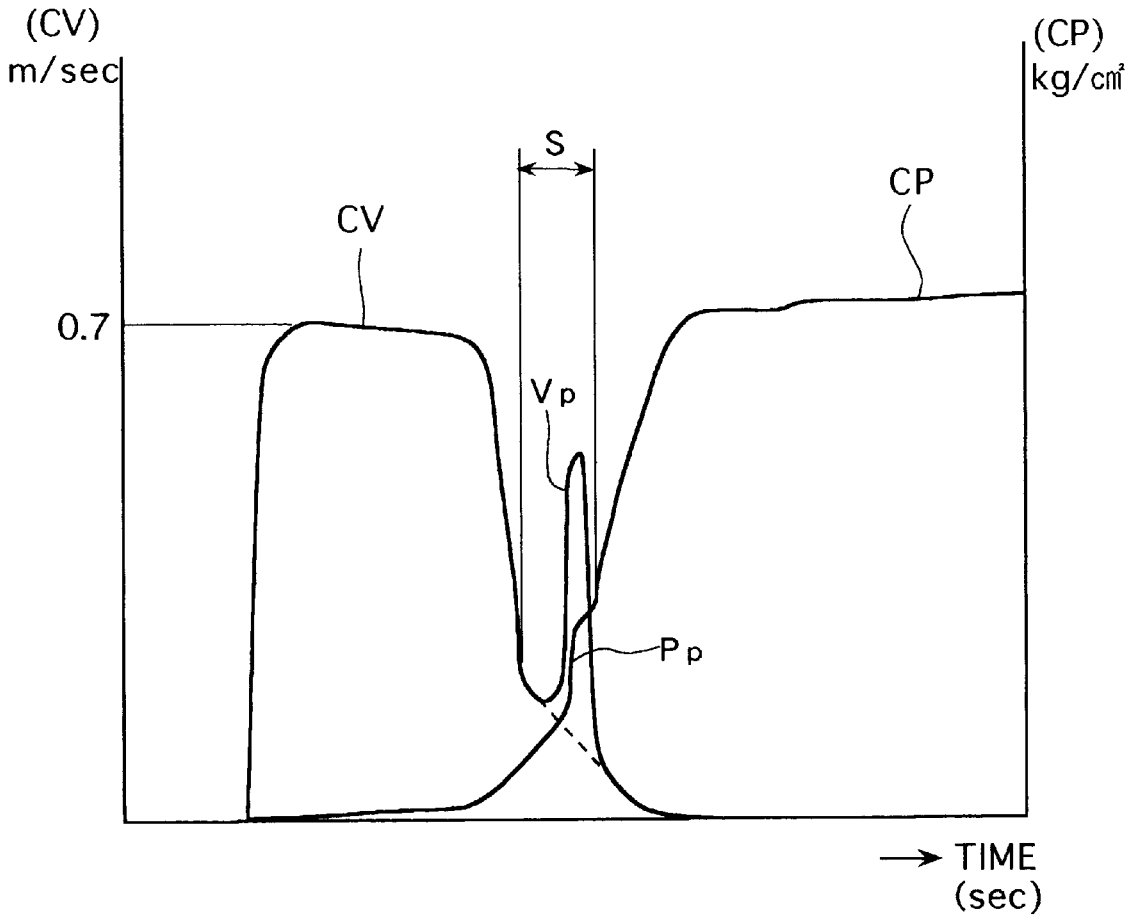
FIG. 14 PRIOR ART
FIG. 14 is a graph showing an injection and a boosting pressure process for describing a disadvantage of injecting a highly viscous molten material in the conventional die-casting machine.

In FIG. 9, the first channel 41 is opened in advance by the open-shut valve 43 and the second channel 42 is shut by the boost cylinder flow-control valve 45.

As a result, the structure of the die-casting machine becomes similar to a conventional die-casting machine. When the injection process and boosting pressure process is conducted by the injection cylinder device 10 and the boost cylinder device 20 in this condition, since the first channel 41 is open, the fluid resistance at the back-pressure side of the boost cylinder device 20 becomes enough small to allow the boost cylinder device to work appropriately.

[Effect]

According to the present embodiment, in injecting the highly viscous molten material into the casting mold, the highly viscous molten material is filled into the cavity by the boost cylinder device 20 when the head of the molten material reaches to or around the gate portion of the casting mold, while the speed and position of the boost cylinder device 20 is controlled in accordance with the preset program. Therefore, when a great change in the gate resistance is caused in filling the cavity with the highly viscous molten material by the boost cylinder device 20, inappropriate change in the injection speed which is out of the predetermined speed can be diminished and the casting pressure can be maintained within an appropriate range. Accordingly, the quality of the die-casting product is not deteriorated.

Further, when the first channel 41 is opened by the open-shut valve 43 and the second channel 42 is shut by the boost cylinder flow-control valve 45, the structure of the present embodiment becomes similar to an ordinary diecasting machine. Therefore, the die-casting product can be produced by conducting injection process and boosting pressure process by the injection cylinder device and the boost cylinder device.

According to the present embodiment, a back-pressure control valve using high-speed responsive electrohydraulic servovalve is employed as the injection cylinder flow-control valve 17 and the boost cylinder flow-control valve 45 to regulate the back-pressure of the injection cylinder device 10 and the boost cylinder device 20 so that the advance position and the speed of the injecting piston 14 and the boosting piston 26 is feed-back controlled. Therefore, the advance condition of the injection cylinder device 10 and the boost cylinder device 20 can be appropriately controlled in the injection process and the boosting pressure process, which is effective in manufacturing a high-quality die-casting products. When the boost cylinder flow-control valve 45 is composed of the high-speed responsive electro-hydraulic proportional flow-control valve, an effect similar to the above can be obtained Since the ratio (S2/S1) of the cylinder stroke of the boost cylinder device 20 (S2) relative to the cylinder stroke of the injection cylinder device 10 (S1) is set larger than one fourth (¼) which is employed in conventional device, the cylinder stroke of the boost cylinder device 20 can be set longer and advantageous injection filling power can be obtained in filling the casting mold with highly viscous molten material.

Further, by forming the open-shut valve 43 and the boost cylinder flow-control valve 45 with a single high-speed responsive electrohydraulic servovalve as shown in FIG. 3, the number of parts of the die-casting machine can be reduced.

Since the boost cylinder control valve 21 is an electric direction switching valve while the main spool of the boost cylinder control valve 21 is a two-way valve as a check valve, the above-described boost pressure control can be securely conducted with a simple structure.

In the injection process, the injection cylinder flow-control valve 17 can variably control the advance of the injection cylinder device 10 by the back-pressure thereof. And when the boosting pressure process can be effectively conducted by releasing the back-pressure control of the injection cylinder device 10, which is effective in manufacturing high-quality die-casting products.

Further, since the injection accumulator 13 and the boost accumulator 23 is provided independently, the pressure can be set independently in injection process and boosting pressure process.

Since the pressure of boost accumulator is controlled by the casting pressure control valve 34, optional controlling of the maximum pressure in boosting pressure process can be conducted easily and securely.

[Modifications etc.]

The scope of the present invention is not limited to the above-described embodiment, but the present invention includes following modifications etc.

The injection accumulator 13 and the boost accumulator 23 may not be independently provided, but a single common accumulator may be used.

The speed and the position of the injecting piston 15 is controlled in a meter-out control by the injection cylinder flow-control valve 17 in the above-described embodiment, but meter-in control may be employed in the present invention.

The particulars such as shape, dimension, material of the respective components, such as the boost cylinder flow-control valve 45 and the injection cylinder flow-control valve 17 can be optionally selected in view of practicing condition. For instance, the ratio (S2/S1) of the cylinder stroke (S2) of the boost cylinder device 20 relative to the cylinder stroke (S1) of the injection cylinder device 10 may be smaller or the same as one fourth as in a conventional die-casting machine.

What is claimed is:

1. A method for controlling injection in a die-casting machine, the diecasting machine having a casting mold with a gate portion for molten material to flow in, an injection plunger for injecting the molten material into the casting mold, an injection cylinder device for driving the injection plunger, an injecting piston provided to the injection cylinder device, a boost cylinder device for boosting pressure applied to hydraulic fluid supplied to the injection cylinder device, a boosting piston provided to the boost cylinder device, and a hydraulic channel for discharging the hydraulic fluid from a back-pressure side of the boost cylinder device, comprising the steps of:

providing an injection cylinder flow-control valve to the injection cylinder device for controlling a speed and a position of the injecting piston, a boost cylinder control valve to the boost cylinder device for operating the boost cylinder device, an open-shut valve for opening and shutting the hydraulic channel and a boost cylinder flow-control valve for regulating the flow of the hydraulic fluid discharged from the boost cylinder device;

when a highly viscous molten material is injected into the casting mold, driving the injection cylinder device by actuating the injection cylinder flow-control valve while shutting the hydraulic channel by the open-shut valve and the boost cylinder flow-control valve;

when the injection plunger reaches approximately an entrance of the gate portion of the casting mold, driving the boost cylinder device to assist the drive of the injection cylinder device by actuating the boost cylinder control valve and the boost cylinder flow-control valve for discharging the hydraulic fluid from the boost cylinder device while controlling the flow of the hydraulic fluid; and when the molten material is completed to be filled in the casting mold, boosting the pressure applied to the molten material in the casting mold by the boost cylinder device.

2. The method for controlling injection in the die-casting machine according to claim 1, wherein the position and the speed of the injecting piston is feed-back controlled by controlling a back-pressure of the injection cylinder device with a back-pressure control valve employing a high-speed responsive electrohydraulic servovalve provided to hydraulic fluid discharging channel of the injection cylinder device; and wherein the position and the speed of the injecting piston is feed-back controlled by controlling the back-pressure of the boost cylinder device with a back-pressure control valve employing a high-speed responsive electrohydraulic servovalve provided to hydraulic fluid discharging channel of the boost cylinder device.

3. The method for controlling injection in the die-casting machine according to claim 1, wherein a ratio (S2/S1) of a cylinder stroke (S2) of the boost cylinder device relative to a cylinder stroke (S1) of the injection cylinder device is larger than one fourth.

4. An apparatus for controlling injection in a die-casting machine, the diecasting machine having a casting mold with a gate portion for molten material to flow in, an injection plunger for injecting molten material into the casting mold, an injection cylinder device for driving the injection plunger, an injecting piston provided to the injection cylinder device, a boost cylinder device for boosting pressure applied to hydraulic fluid supplied to the injection cylinder device, a boosting piston provided to the boost cylinder device, and a hydraulic channel for discharging the hydraulic fluid from a back-pressure side of the boost cylinder device, comprising:

an injection cylinder flow-control valve for controlling a speed and a position of the injecting piston;

a boost cylinder control valve for driving the boost cylinder device;

an open-shut valve provided to the hydraulic channel for opening and shutting the hydraulic channel; and a boost cylinder flow-control valve provided to the hydraulic channel for controlling a flow of the hydraulic fluid discharged from the boost cylinder device through the hydraulic channel;

wherein the open-shut valve shuts the hydraulic channel when a highly viscous molten material is filled into the casting mold; and wherein the boost cylinder flow-control valve shuts the hydraulic channel when the highly viscous molten material is filled into the casting mold, and regulates the hydraulic channel so that the flow of the hydraulic fluid is controlled to be discharged through the hydraulic channel while the injection cylinder device is in operation.

5. The apparatus for controlling injection in the die-casting machine according to claim 4, further comprising first channel and second channel both of which are provided to the hydraulic channel and are connected in parallel to the back-pressure side of the boost cylinder device, wherein the open-shut valve is provided to an intermediate part of the first channel, and wherein the boost cylinder flow-control valve is provided to an intermediate part of the second channel.

6. The apparatus for controlling injection in the die-casting machine according to claim 4, wherein the open-shut valve and the boost cylinder flow-control valve are composed of a single high-speed responsive electrohydraulic servovalve.

* * * * *

UNITED STATES PATENT AND TRADEMARK OFFICE

CERTIFICATE OF CORRECTION

PATENT NO. : 5,957,192
DATED : September 28, 1999
INVENTOR(S) : Hiroshi KITAMURA et al.

It is certified that error appears in the above-identified patent and that said Letters Patent is hereby corrected as shown below:

Claim 1, Column 12, line 9, "diecasting" should read --die-casting--.

Claim 4, Column 12, line 67, "diecasting"should read --die-casting--.

Signed and Sealed this

Third Day of April, 2001

Nicholas P. Godici

*Attest:*

NICHOLAS P. GODICI

*Attesting Officer*

*Acting Director of the United States Patent and Trademark Office*